US008784618B2

(12) United States Patent
Arvin et al.

(10) Patent No.: US 8,784,618 B2
(45) Date of Patent: Jul. 22, 2014

(54) WORKING ELECTRODE DESIGN FOR ELECTROCHEMICAL PROCESSING OF ELECTRONIC COMPONENTS

(75) Inventors: Charles L. Arvin, Poughkeepsie, NY (US); Raschid J. Bezama, Mahopac, NY (US); Glen N. Biggs, Wappinger Falls, NY (US); Hariklia Deligianni, Tenafly, NJ (US); Tracy A. Tong, Wallkill, NY (US)

(73) Assignee: International Business Machines Corporation, Armonk, NY (US)

( * ) Notice: Subject to any disclaimer, the term of this patent is extended or adjusted under 35 U.S.C. 154(b) by 673 days.

(21) Appl. No.: 12/806,719

(22) Filed: Aug. 19, 2010

(65) Prior Publication Data

US 2012/0043216 A1 Feb. 23, 2012

(51) Int. Cl.
*C25D 17/00* (2006.01)
*C25D 7/12* (2006.01)

(52) U.S. Cl.
CPC ..... *C25D 17/001* (2013.01); *C25D 17/004* (2013.01); *C25D 7/123* (2013.01)
USPC ..... 204/230.7; 205/96

(58) Field of Classification Search
USPC ..... 204/297.01, 297.03, 297.06, 297.09, 204/297.1, 198, 202, 224 R, 228.9, 230.7; 205/96, 97
See application file for complete search history.

(56) References Cited

U.S. PATENT DOCUMENTS 2,044,415 A * 6/1936 Yates ..... 205/77
3,437,578 A * 4/1969 Herriges et al. ..... 204/230.7
3,862,891 A * 1/1975 Smith ..... 205/96
4,304,641 A * 12/1981 Grandia et al. ..... 205/96
5,135,636 A * 8/1992 Yee et al. ..... 205/96
5,378,851 A 1/1995 Brooke et al.
6,071,388 A * 6/2000 Uzoh ..... 204/287
6,156,167 A * 12/2000 Patton et al. ..... 204/270
6,168,693 B1 1/2001 Uzoh et al.
6,193,859 B1 * 2/2001 Contolini et al. ..... 204/224 R
6,228,242 B1 * 5/2001 Lavelaine et al. ..... 205/143

(Continued)

FOREIGN PATENT DOCUMENTS

JP 2000-054198 A * 2/2000

OTHER PUBLICATIONS

K.S. Drese, "Deign Rules for Elctroforming in LIGA Process," J. Electrochem. Soc, vol. 151, No. 6, 2004, pp. D39-D45.

(Continued)

*Primary Examiner* — Harry D Wilkins, III
(74) *Attorney, Agent, or Firm* — Scully, Scott, Murphy & Presser, P.C.; Vazken Alexanian

(57) ABSTRACT

An electroplating apparatus is provided that includes a plating tank for containing a plating electrolyte. A counter electrode, e.g., anode, is present in a first portion of the plating tank. A cathode system is present in a second portion of the plating tank. The cathode system includes a working electrode and a thief electrode. The thief electrode is present between the working electrode and the counter electrode. The thief electrode includes an exterior face that is in contact with the plating electrolyte that is offset from the plating surface of the working electrode. In one embodiment, the thief electrode overlaps a portion of the working electrode about the perimeter of the working electrode. In one embodiment, a method is provided of using the aforementioned electroplating apparatus that provides increased uniformity in the plating thickness.

9 Claims, 7 Drawing Sheets

(56) References Cited

U.S. PATENT DOCUMENTS

| | | | | |
|---|---|---|---|---|
| 6,238,529 | B1 * | 5/2001 | Geissler et al. | 204/202 |
| 6,261,433 | B1 * | 7/2001 | Landau | 205/96 |
| 6,669,833 | B2 * | 12/2003 | Kaja et al. | 205/96 |
| 6,827,827 | B2 * | 12/2004 | Nakamoto et al. | 204/230.2 |
| 6,896,784 | B2 * | 5/2005 | Cheng et al. | 205/81 |
| 7,172,184 | B2 | 2/2007 | Pavani et al. | |
| 7,214,297 | B2 * | 5/2007 | Wang et al. | 204/297.01 |
| RE40,218 | E * | 4/2008 | Landau | 205/96 |
| 7,540,946 | B2 * | 6/2009 | Miyata et al. | 204/228.8 |
| 7,563,352 | B2 * | 7/2009 | Hubel | 205/82 |
| 7,727,364 | B2 * | 6/2010 | Singh et al. | 204/230.7 |
| 7,842,173 | B2 * | 11/2010 | McHugh et al. | 204/272 |
| 7,901,550 | B2 * | 3/2011 | Makino et al. | 204/297.01 |
| 7,981,259 | B2 * | 7/2011 | Hafezi et al. | 204/230.7 |
| 2006/0074241 | A1 | 4/2006 | Chen et al. | |
| 2006/0207874 | A1 * | 9/2006 | Miyata et al. | 204/230.7 |
| 2007/0289871 | A1 * | 12/2007 | Hafezi et al. | 205/80 |
| 2008/0179180 | A1 | 7/2008 | McHugh et al. | |
| 2008/0217181 | A1 | 9/2008 | Hautier et al. | |
| 2009/0095634 | A1 * | 4/2009 | Makino et al. | 205/223 |
| 2012/0043217 | A1 * | 2/2012 | Arvin et al. | 205/261 |
| 2012/0043301 | A1 * | 2/2012 | Arvin et al. | 216/86 |

OTHER PUBLICATIONS

S. Mehdizadeh, et al., "Optimization of Electrodeposit Uniformity by the Use of Auxiiliary Electrodes," J. Electrochem, Soc., vol. 137, No. 1, Jan. 1990, pp. 110-117.

Catherine M. Cotell, et al., "Surface Engineering", ASM Handbook, vol. 5, pp. 165-329; Copyright 1994, Second printing Feb. 1996.

* cited by examiner

WORKING ELECTRODE DESIGN FOR ELECTROCHEMICAL PROCESSING OF ELECTRONIC COMPONENTS

BACKGROUND

The present disclosure relates generally to electroplating. More particularly and in some embodiments, the present disclosure relates to electroplating operations that include thief electrodes.

Microelectronic devices, such as semiconductor devices, imagers, displays, storage media, and micromechanical components, are generally fabricated on and/or in microfeature wafers using a number of processes that deposit and/or remove materials from the wafers. Electroplating is one such process that deposits conductive, magnetic or electrophoretic layers on the wafers. Electroplating processes, for example, are widely used to form small copper interconnects or other very small sub-micron features in trenches and/or holes (e.g., less than 90 nm damascene copper lines). In electroplating, an electrical current is passed between the wafer, i.e., work electrode, such as a cathode, and one or more counter electrodes, such as an anode, in a manner that deposits material on a surface of the wafer.

SUMMARY

An electrode system of an electroplating apparatus is provided that includes a working electrode having a plating surface, and a thief electrode that is separated from the working electrode, in which a face of the thief electrode that is in contact with a plating electrolyte is offset from the plating surface of the working electrode. The electrode system further includes at least one power supply in to the working electrode and the thief electrode.

In another aspect, an electroplating apparatus is provided that includes a plating tank for containing a plating electrolyte. A counter electrode, e.g., anode, is present in a first portion of the plating tank. A cathode system is present in a second portion of the plating tank. The cathode system includes a working electrode and a thief electrode. The thief electrode is present between the working electrode and the counter electrode. The thief electrode includes an exterior face that is in contact with the plating electrolyte that is offset from the plating surface of the working electrode.

In another aspect, a plating method is provided that includes providing a plating tank containing a plating electrolyte having at least one metal compound. An anode and a cathode system are positioned in an electrolyte bath. The cathode system includes a working electrode having a plating surface and a thief electrode that is separated from the working electrode. The thief electrode includes an exterior face that is in contact with the plating electrolyte and is offset from the plating surface of the working electrode. A bias is applied to the anode and the cathode system, wherein the metal compound dissociates to provide metal ions that are plated on the surface of the working electrode. The plating formed on the plating surface of the working electrode has a uniform thickness from the perimeter of the plating surface to the center of the plating surface.

BRIEF DESCRIPTION OF THE SEVERAL VIEWS OF THE DRAWINGS

The following detailed description, given by way of example and not intended to limit the invention solely thereto, will best be appreciated in conjunction with the accompanying drawings, wherein like reference numerals denote like elements and parts, in which.

DETAILED DESCRIPTION

Figure 1A:
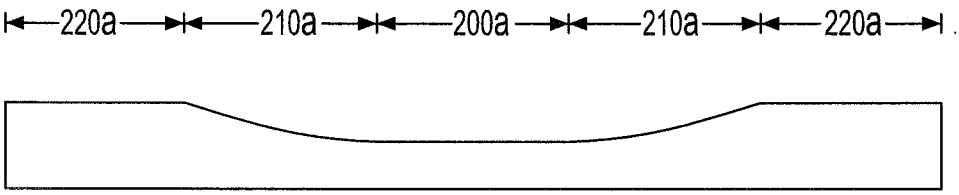
FIG. 1A is a side cross-sectional view of a plating produced by a large thief that is coplanar to the plating surface.

Detailed embodiments of the present invention are disclosed herein; however, it is to be understood that the disclosed embodiments are merely illustrative of the invention that may be embodied in various forms. In addition, each of the examples given in connection with the various embodiments of the invention are intended to be illustrative, and not restrictive. Further, the figures are not necessarily to scale, some features may be exaggerated to show details of particular components. Therefore, specific structural and functional details disclosed herein are not to be interpreted as limiting, but merely as a representative basis for teaching one skilled in the art to variously employ the present invention.

References in the specification to "one embodiment", "an embodiment", "an example embodiment", etc., indicate that the embodiment described may include a particular feature, structure, or characteristic, but every embodiment may not necessarily include the particular feature, structure, or characteristic. Moreover, such phrases are not necessarily referring to the same embodiment. Further, when a particular feature, structure, or characteristic is described in connection with an embodiment, it is submitted that it is within the knowledge of one skilled in the art to affect such feature, structure, or characteristic in connection with other embodiments whether or not explicitly described.

For purposes of the description hereinafter, the terms "upper", "lower", "right", "left", "vertical", "horizontal", "top", "bottom", and derivatives thereof shall relate to the invention, as it is oriented in the drawing figures. The terms "overlying", "atop", "positioned on" or "positioned atop" mean that a first element, such as a first structure, is present on a second element, such as a second structure, wherein intervening elements, such as an interface structure may be present between the first element and the second element. The term "direct contact" means that a first element, such as a first structure, and a second element, such as a second structure, are connected without any intermediary conducting, insulating or semiconductor layers at the interface of the two elements.

The present disclosure is applicable to electrochemical processes requiring the application of an external field, such as plating, anodizing, electropolishing, electrochemical etching and colloidal deposition. In addition, some non-applied external field electrochemical processes may also benefit from the designs disclosed herein.

In one embodiment, an electroplating apparatus is disclosed having a thief electrode that is present about a perimeter of a working electrode, and is separated from the working electrode, in which a face of the thief electrode that is in contact with a plating electrolyte is offset from the plating surface of the working electrode. Electroplating is the process of producing a coating, usually metallic, on a surface by the action of electric current. The deposition of a metallic coating onto an object is achieved by putting a negative charge on the object to be coated and immersing it into a solution, i.e., plating electrolyte, that contains a salt of a metal to be deposited. The metallic ions of the salt carry a positive charge and are thus attracted to the object. When the metallic ions reach the negatively charged object (that is to be electroplated), it provides electrons to reduce the positively charged ions to metallic form.

It has been determined that by positioning the thief electrode to be offset from the plating surface of the working electrode that the uniformity of the plating thickness may be increased. Electroplating devices that do not include a thief electrode or include a thief electrode that is not offset from the plating surface of the working electrode have increased plating thickness at the edge, i.e., perimeter, of the working electrode. In comparison, an electroplated metal film produced by an electroplating apparatus in which the face of the thief electrode that is in contact with the plating electrolyte is offset from the plating surface of the working electrode has a uniform thickness extending across the entirety of the plating surface including the portion of the plating at the edge of the working electrode. As used herein, the term "uniform thickness" means that the uniformity of the plating has a variation of the thickness from across the deposition substrate from a first edge, i.e., at a first portion of the perimeter, across the center of the deposition substrate to an opposing second edge, i.e., at a second portion of the perimeter, of less than 5% of one sigma (one standard deviation) for the plating thickness.

The present disclosure is generally directed to batch and continuous plating tools. Batch plating is a form of plating in which the holder containing a first part, i.e., first workpiece, to be plated is positioned in a plating cell, and then once the plating is complete in that plating cell the holder is removed. Thereafter, a holder containing a second part, i.e., second workpiece, is positioned in the plating cell and the plating process is repeated. In a batch process there is no continuity between the plating process for the first part and the plating process for the second part. FIGS. 2A-6C depict some embodiments of batch plating apparatus in accordance with the present disclosure.

Another form of plating that may employ the principles of the present disclosure is continuous plating. Continuous plating apparatus provides for plating using multiple holders each corresponding to a part to be plated, i.e., workpiece, in which each holder is traversed through a single plating tank. While each of the holders is being traversed through the plating tank, the workpiece that is being held on the holder is plated. As a first holder containing the plated workpiece is removed from the plating tank, a second holder containing a new workpiece enters the plating tank to be plated. FIGS. 7A-10B depict some embodiments of continuous plating. Although the holder is being traversed through the plating tank in a vertical orientation in FIGS. 7A-10B, the holder may also be orientated horizontally. Further, the continuous plating apparatus may be a reel-to-reel plating apparatus.

FIGS. 2A-4C and 7A-10B each depict a thief electrode 20*a*, 20*b*, 20*f*, 20*g* that contributes to providing a plating that is substantially uniform across the entire width of the deposited plating. Thief electrodes typically have a surface area that provides a thief electrode to plating part surface area ratio of 3:1, in which the thief electrode is mounted to be coplanar with the plating surface of the plating part. By co-planar it is meant that the surface of the thief electrode that is contact with the plating electrolyte, and is opposite the surface that is in contact with the holder on which the thief electrode is mounted, is present on the same plane as the face of the plating surface on which the plating is being formed. It has been determined that large thief electrodes, such as thief electrodes that provide a thief electrode surface area to plating surface area ratio of 3:1 or greater, and co-planar thief electrode mounting geometries, remove at least 40% of the current that would have been applied to the plating part during the plating operation if the thief electrode was not present. A large thief electrode that is co-planar to the plating surface will require a large total power differential between the thief electrode and the part to be plated, and will not only remove current from the edge of the plating surface, but will also removes current across the entire width of the plating surface. The result in a plating having a uniform edge portion 220*a*, but also having regions of non-uniform thickness at the center portion 200*a* of the plating and the intermediate portion 210*a* of the plating that is between the center portion 200*a* and the edge portion 220*a* of the plating, as depicted in FIG. 1A.

Figure 1B:
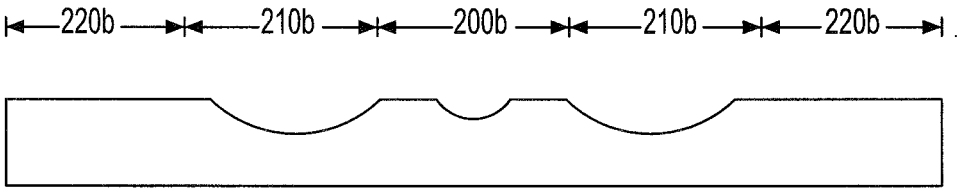
FIG. 1B is a side cross-sectional view of a plating produced by a large thief electrode that is non-planar to the plating surface.
Figure 1C:
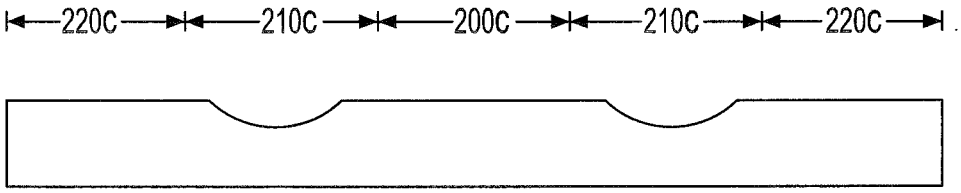
FIG. 1C is a side cross-sectional view of a plating produced by a small thief electrode that is coplanar to the plating surface.

It has further been determined that when the thief electrode is non-planar and is large, i.e., the thief electrode has a thief electrode to plating part surface area ratio of 3:1 or greater, the necessary power that is being applied to the thief will remove at least 30% of the current that would have been applied the part to be plated if the thief electrode was not present. Non-planar denotes that the surface of the thief electrode that is contact with the plating electrolyte, and is opposite the surface that is in contact with the holder on which the thief electrode is mounted, is offset from and is not present on the same plane as the face of the plating surface on which the plating is being formed. A thief electrode that is non-planar and large requires less of a total power differential than a large thief that is co-planar to the plating surface. A large thief electrode that is non-planar with the plating surface not only removes current from the edge of the plating surface, but also removes current from across the entire plating part. But, the degree by which the current is removed across the entire plating surface is less than the amount of current that is removed in thief electrodes that are large and co-planar with the plating surface. FIG. 1B depicts a cross section of a plating formed by a large non-planar thief electrode, in which the edge portions 220*b* of the plating are uniform, but the plating also includes regions of non-uniform thickness at the center portion 200*b* of the plating and the intermediate portion 210*b* of the plating. The degree of non-uniformity at the center portion 200*b* of the plating produced by a large and non-planar thief electrode is reduced when compared to the center portion 200*a* of the plating that is produced by a large and co-planar thief electrode When the thief electrode is co-planar and small, the necessary power on the thief electrode to smooth the edge of the plating removes about 5% or less of the current that would have been applied to the plating part during the plating operation if the thief electrode was not present. In one embodiment, a small thief electrode is a thief electrode that has a ratio of thief electrode surface area to plating surface area ranging from 1:8 to 1:12. In another embodiment, a small thief electrode is a thief electrode that has a ratio of thief electrode surface area to plating surface area ratio ranging from 1:9 to 1:11. In yet another embodiment, a small thief electrode is a thief electrode that has a ratio of thief electrode surface area to plating surface area ratio of 1:10. FIG. 1C depicts the uniformity of the plating that is provided by a thief electrode that is co-planar and small. The small and co-planar thief electrode provides thickness uniformity at the edge portions 220*c* and center portions 200*c* of the plating, but results in non-uniformity of the thickness at the intermediate portion 210*b* of the plating that is present between the center portion 200*c* and the etch portions 220*c*, as depicted in FIG. 1C.

Figure 1D:
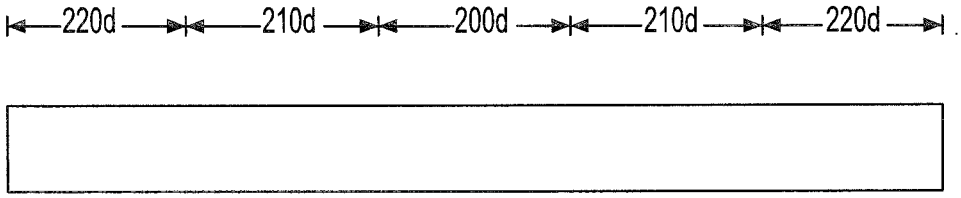
FIG. 1D is a side cross-sectional view of a plating produced by a small thief electrode that is non-planar to the plating surface.

FIG. 1D illustrates the plating provided by an apparatus including a small thief electrode that is non-planar and blocking. As depicted in FIG. 1D uniformity of the plating that is produced by the small, non-planar and blocking thief electrode is increased in comparison to the plated produced by a small and co-planar thief electrode. The small, non-planar and blocking thief electrode provides thickness uniformity in each of the edge portions 220*d*, intermediate portions 210*d* and center portion 200*d* of the plating. As used herein, the term "blocking" as used to describe a thief electrode means that a portion of the thief electrode extends beyond the edge of the lip portion of the holder that is retaining the working electrode, i.e., plating surface. The details of blocking thief electrodes are described in greater detail in the following discussion.

Figure 2A:
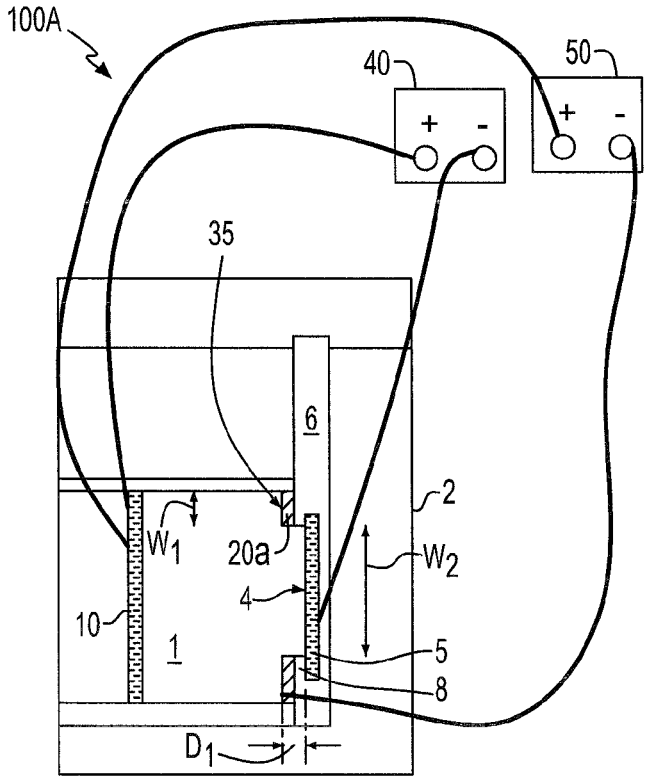
FIG. 2A is a side cross-sectional view of an electroplating apparatus including an out of plane non-blocking thief electrode, in accordance with one embodiment of the present disclosure.
Figure 2B:
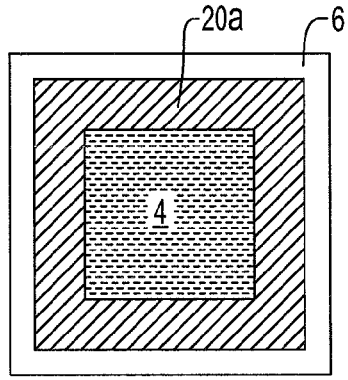
FIG. 2B is a perspective view towards the deposition surface of one embodiment of a cathode system included in the electroplating apparatus that is depicted in FIG. 2A, in which the cathode and the thief electrode are substantially circular, in accordance with one embodiment of the present disclosure.
Figure 2C:
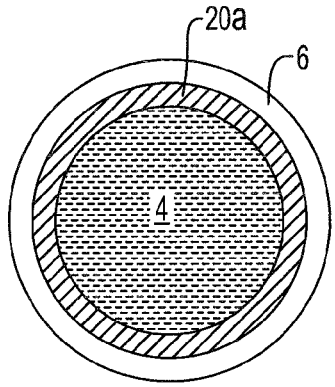
FIG. 2C is a perspective view towards the deposition surface of one embodiment of a cathode system included in the electroplating apparatus that is depicted in FIG. 2A, in which the cathode and the thief electrode are multi-sided, in accordance with one embodiment of the present disclosure.

FIGS. 2A-2C depict one embodiment of an electroplating apparatus 100A having a thief electrode 20*a* that is present about a perimeter of a working electrode 5, and is separated from the working electrode 5, wherein an exterior face 35 of the thief electrode 20*a* is in contact with a plating electrolyte 1 and is offset from the plating surface 4 of the working electrode 5. The thief electrode 20*a* depicted in FIGS. 2A-2C may be referred to an out of plane non-blocking thief electrode. As used herein, a "thief electrode" is an electrode that is placed relative to the plating surface 4 of the working electrode 5 so as to divert to itself some current from portions of the work electrode 5. As used herein, the "working electrode" is the electrode of the plating system at which the metal plating is being deposited. The working electrode contains the plating surface. The "counter electrode" is the electrode having the opposite charge as the working electrode. For example, when the working electrode 5 is connected to the negative terminal of the power supply 40, the working electrode 5 is the cathode and the counter electrode 10 is the anode. Although the examples included herein describe the working electrode 5 as being the cathode, and the counter electrode 10 as being the anode, embodiments have been contemplated in which the working electrode is the anode and the counter electrode is the cathode.

Referring to FIG. 2A, in one embodiment, the electroplating apparatus includes a cathode system including a working electrode 5 comprising a plating surface 4 and a thief electrode 20*a* that is separated from the working electrode 5. The thief electrode 20*a* and the working electrode 5 are both mounted to a holder 6. The holder 6 supports the working electrode 5 and the thief electrode 20*a* while the thief electrode 20*a* is immersed in the plating electrolyte 1 that is contained by the plating tank 2.

The exterior face 35 of the thief electrode 20*a* is offset from the plating surface 4 of the working electrode 5. The exterior face 35 of the thief electrode 20*a* is the face of the thief electrode 20*a* that is opposite the face of the thief electrode 20*a* that is in direct contact with the holder 6 of the working electrode 5. In one embodiment, by "offset" it is meant that the exterior face 35 of the thief electrode 20*a* is not on the same plane as the plating surface 4 of the working electrode 5. Therefore, the exterior face 35 of the thief electrode 20*a* and the plating surface 4 of the working electrode 5 are not co-planar. In one embodiment, the dimension D1 that defines the degree by which the exterior face 35 of the thief electrode is offset from the plating surface 4 of the working electrode 5 ranges from 0.5 mm to 50 mm. In another embodiment, the dimension D1 defining the degree by which the exterior face 35 of the thief electrode is offset from the plating surface 4 of the working electrode 5 ranges from 1 mm to 5 mm.

In the embodiment depicted in FIG. 2A, the plane that the width W1 of the exterior face 35 defines is substantially parallel to the plane that is defined by the width W2 of the plating surface 4 of the working electrode 5. Although, the plating surface 4 and the exterior face 35 of the thief electrode 20*a* are depicted as being planar, embodiments have been contemplated in which the exterior face 35 of the thief electrode 20*a* and the plating surface 4 are non-planar. In these embodiments, an offset non-planar exterior face 35 of the thief electrode 20*a* is provided by any portion of the surface that is on a different plane than the exterior face of the plating surface 4.

The thief electrode 20*a* is incorporated around the working electrode 5 to improve the uniformity of electrodeposited metal on the working electrode 5 and to control the profile of the deposited metal. Generally, the working electrode 5 is disposed in close proximity to the thief electrode 20*a* during the plating process. To prevent the thief electrode 20*a* from shorting to the working electrode 5, an insulating spacer is used to isolate the thief electrode 20*a* from the working electrode 5. Bridging of the thief electrode 20*a* to the working electrode 5 disadvantageously distorts the desired metal distribution profile on the working electrode 5 thus producing a defective part, and further requiring a rework operation.

The insulating spacer is typically a component of the holder 6 for the working electrode 5. As used herein, the term "insulating" means a material having a room temperature conductivity of less than about $10^{-10}$ $(\Omega\text{-m})^{-1}$. Examples of materials suitable for the insulating spacer include rubber, plastic, glass and ceramics. The insulating spacer is typically configured to separate the thief electrode 20*a* from the working electrode by a dimension ranging from 0.25 mm to 5.0 mm. In one embodiment, the insulating spacer is configured to separate the thief electrode 20*a* from the working electrode 5 by a dimension ranging from 0.5 mm to 3.0 mm. In yet another embodiment, the thin insulating spacer is configured to separate the thief electrode 20*a* from the working electrode by a dimension on the order of 1.0 mm In one embodiment, the thief electrode 20*a* is typically composed of a wire mesh material. Using a mesh material as the thief electrode 20*a* increases the surface area of the thief electrode 20*a*. Typically, a mesh thief electrode 20*a* can be used for a longer period of time than a thief electrode 20*a* that is composed of a solid metal. Regular maintenance of the thief electrode 20*a* is done by periodic removal (deplating or electroetching) of the plated metal on the thief electrode 20*a*.

The wire mesh material is typically composed of stainless steel or titanium (Ti), and in some examples has a wiring diameter ranging from 0.25 mm to 1.25 mm, and a grid spacing that ranges from 1 mm to 10 mm. In one example, the wiring diameter of the wire mesh that provides the thief electrode 20*a* ranges from 0.5 mm to 0.75 mm, and the grid spacing ranges from 2 mm to 5 mm. The composition of the wire mesh material and its geometry is selected to allow for maximum flow while maintaining a smooth electric field. The thief electrode 20*a* may also be composed of a solid electrode material. The geometry of the thief electrode 20*a* is typically selected to conform to the geometry of the working electrode 5.

The working electrode 5 may be composed of any electrically conductive material that is to be plated. As used herein, "conductive" denotes a room temperature conductivity of greater than about $10^{-8}$ $(\Omega\text{-m})^{-1}$. Examples of suitable materials for the working electrode 5 include elemental elements including, but not limited to Cu, Ag, Ni, Fe, Al, Zn, Pd, platinized Ti, Co, Mo, Sn Ta, Ir, Pt, Pb, Bi, Cr, Nb, Zr, Au, SS 304, SS 316, Ti and combinations and alloys thereof. The working electrode 5 may also be composed of semiconductor materials, so long as the working electrode 5 is conductive so that it may be biased to attract positively charged metal ions from the plating electrolyte 1. The working electrode 5 may have any geometry to be plated.

The working electrode 5 is mounted to a holder 6, which supports the working electrode 5 while immersed in the plating tank 2 that contains the plating electrolyte 1. The holder 6 is composed of a non-conductive material, i.e., insulating material, such as a polymeric material, e.g., plastic or rubber, or glass material. The holder 6 is typically composed of the same material as the plating tank 1.

The holder 6 may include a lip portion 8 having a surface that extends over and in direct contact with the working electrode 5. The plating surface 4 of the working electrode 5 is the exposed portion of the working electrode 5 that is in direct contact with the lip portion 8 of the holder 6. The opposing side, i.e., opposing surface, of the lip portion 8 that is not in direct contact with the working electrode 5 is in direct contact with the thief electrode 20*a*. The lip portion 8 may function as the insulating spacer that obstructs the working electrode 5 from being shorted to the thief electrode 20*a*.

As used herein, the term "non-blocking" as used to describe the thief electrode 20*a* means that the thief electrode 20*a* does not extend past the edge of the lip portion 8 of the holder 6 that is retaining the working electrode 5. This means that the thief electrode 20*a* is not overlapping the plating surface 4 of the working electrode 5.

FIG. 2B depicts one embodiment of a substantially circular thief electrode 20*a*, a substantially circular working electrode 5 and a substantially circular lip portion 8 of the holder 6. FIG. 2C depicts one embodiment of a multi-sided thief electrode 20*a*, a multisided circular working electrode 5 and a multi-sided lip portion 8 of the holder 6. FIGS. 2B and 2C further depict where the thief electrode 20*a* is present about the perimeter of the working electrode 5. The shape of the thief electrode 20*a* images the outline of the working electrode 5. In one embodiment, the thief electrode 20*a* is continuously present about the perimeter of the working electrode 5. By "continuously present" it is meant that there are no breaks in the body of the thief electrode 20*a* that is present about the entirety of the perimeter of the working electrode 5.

Referring again to FIG. 2A, the electroplating apparatus 100A further includes a plating tank 2 that contains the plating electrolyte 1. The plating tank 2 may be any vessel capable of holding a plating electrolyte 1, i.e., liquid solution. The plating tank 2 is typically composed of a non-conductive material, i.e., insulating material. Examples of materials for the plating tank 2 include glass, rubber, plastic or Koroseal™. Although, the plating tank 2 is typically a polymer, embodiments have been contemplated, in which low carbon steel is used for the plating tank 2.

The plating electrolyte 1 may be any electrolyte used for electroplating. For copper plating, the plating electrolyte 1 may be an acid or alkaline plating bath, a dilute cyanide bath, Rochelle cyanide bath, sodium cyanide bath, potassium cyanide bath, alkaline noncyanide copper plating bath, or pyrophosphate bath or a combination thereof. In the embodiments, in which copper is being plated onto the working electrode 5, the plating electrolyte 1 may include, but is not limited to, copper cyanide, sodium cyanide, sodium carbonate, sodium hydroxide, Rochelle salt, potassium hydroxide, copper sulfate, sulfuric acid, copper fluoborate and combinations thereof.

In another embodiment, in which chromium is to be plated, the plating electrolyte 1 may be chromic acid in combination with a catalyst, such as sulfate. In another embodiment, to plate nickel, the plating electrolyte 1 composition may include at least one of nickel sulfate, nickel sulfamate, nickel chloride, and boric acid. In yet another embodiment, to plate cadmium, the plating electrolyte 1 composition may be a cyanide bath or a non-cyanide bath. One example of a cyanide bath for plating cadmium includes at least one of cadmium oxide, cadmium metal, sodium cyanide, sodium hydroxide, and sodium carbonate. One example of a non-cyanide bath for plating cadmium includes at least one of ammonium chloride, ammonium fluobarate, ammonium sulfate, boric acid, cadmium, cadmium fluoborate, cadmium oxide, and sulfuric acid.

In a further embodiment, in which zinc is to be plated, the plating electrolyte 1 composition may be a cyanide zinc bath or an alkaline noncyanide bath. In one example, a cyanide zinc bath is composed of at least one of zinc cyanide, sodium cyanide, sodium hydroxide, sodium carbonate, and sodium polysulfide. In one example, a noncyanide bath for plating nickel includes zinc oxide and sodium hydroxide. In yet another embodiment, the plating electrolyte 1 may also provide an indium plating. An indium plating may be provided by an indium fluoroborate plating bath composed of indium fluoroborate, boric acid and ammonium fluoroborate. In another example, the indium plating may be provided by an indium sulfamate plating bath comprising indium sulfamate, sodium sulfamate, sodium chloride, dextrose and triethanolamine. Indium-lead fluobarate and indium-lead sulfamate plating baths are also possible.

Tin may be deposited from a plating electrolyte 1 that is composed of alkaline or acid baths. One example of an alkaline bath suitable for a plating electrolyte 1 that provides tin is composed of potassium stannate, sodium stannante, potassium hydroxide and tin metal. One example of an acid bath, i.e., sulfate (acidic) tin plating electrolyte, suitable for a plating electrolyte 1 that provides tin is composed of stannous sulfate, tin metal (as sulfate), free sulfuric acid, phenolsulfonic acid, β-naphthol, and gelatine.

Lead may be deposited from a plating electrolyte 1 that is composed of fluobarate baths, fluosilicate baths, sulfamate baths and methane sulfonic acid baths. In one example, in which the plating electrolyte 1 is a fluobarate bath, the plating electrolyte 1 is composed of basic lead carbonate, hydrofluoric acid, boric acid and glue.

Silver may be deposited from a plating electrolyte 1 that is composed of a cyanide based solution composed of silver (as $KAg(CN)_2$, g/L (oz/gal)), potassium cyanide, and potassium carbonate. Non-cyanide solutions for electroplating silver include those based on simple salts such as nitride, fluobarate, and fluosilicite; inorganic complexes, such as iodide, thiocyanate, thiosulfate, pyrophosphate, and trimetaphosphate; and organic complexes, such as succiniumide, lactate and thiourea.

In another embodiment, the plating electrolyte 1 may be used to plate, i.e., deposit, gold on the working electrode 5. A plating electrolyte 1 for depositing gold includes a source of gold, a complexing agent, and a conducting salt to help carry the current. The plating electrolyte for gold may also include an additive for color and hardness. In one example, the plating electrolyte for gold comprises gold as potassium gold cyanide, free potassium cyanide, dipotassium phosphate, sodium hydroxide, sodium carbonate, nickel as potassium nickel cyanide, and silver as potassium silver cyanide.

In another embodiment, the plating electrolyte 1 may be an ionic liquid. Ionic liquids that are suitable for plating electrolyte 1 typically have a higher viscosity than water. In one example, the ionic liquid may be a tetra-alkyl ammonium salt. Some of these ionic liquids can be used to deposit materials that can not be deposited using aqueous based plating electrolytes, such as gallium, germanium, silicon and aluminum.

It is noted that the above-described compositions for the plating electrolyte 1 are included for illustrative purposes only, and are not intended to limit the disclosure. Other plating electrolytes have also been contemplated and are within the scope of the present disclosure. For example, the plating electrolyte 1 may also deposit palladium, ruthenium, rhodium, osmium, iridium and platinum.

Still referring to FIG. 2A, a counter electrode 10 may be positioned within the plating tank 2 containing the plating electrolyte 1 and separated from the working electrode 5. The counter electrode 10 may be composed of a material to replenish the plating electrolyte 1 during the electroplating process. When forming copper plating, the counter electrode 10 may be composed of copper or iron. The copper may be cast copper, rolled copper, high purity copper, oxygen free copper and phosphorized copper. When forming a nickel plating, the counter electrode 10 may be composed of nickel. The counter electrode 10 for plating cadmium may be composed of a majority of cadmium, i.e., greater than 99% cadmium, alloyed with lead, iron, copper, arsenic and/or zinc. The counter electrode 10 for plating zinc may be composed of a majority of zinc, e.g., 99% zinc, alloyed with lead, cadmium, iron and copper. Counter electrodes 10 for tin deposition are typically composed of tin. Counter electrodes 10 for lead electroplating include lead and iron. Counter electrodes 10 for silver electroplating may be composed of silver or stainless steel. The counter electrodes 10 may also be composed of Ag, Ni, Fe, Al, Zn, Pd, platinized Ti, Co, Mo, Sn Ta, Ir, Pt, Pb, Bi, Cr, Nb, Zr, SS 304, SS 316, Ti and combinations and alloys thereof.

The electroplating apparatus 100A further comprises a power supply 40 to bias the working electrode 5 and the counter electrode 10. The power supply may be a DC, AC, pulse and pulse reverse power supply. During the plating operation, DC power is typically employed. In other embodiments, pulsed plating may be utilized. In some instances, such as the beginning of a plating process, pulse reverse power may be utilized. AC current in connection with a frequency analyzer can provide diagnostic information about the quality of the plated material, i.e., material being deposited, as a feedback loop that can then be used to turn the thief electrodes on and off. The power supply may also be bipolar, which may facilitate metal stripping operations.

In the embodiment that is depicted in FIG. 2A, the positive terminal of the power supply 40 is electrically connected to the counter electrode 10 and the negative terminal of the power supply 40 is electrically connected to the working electrode 5. In this example; the counter electrode 10 provides the anode, and the working electrode 5 provides the cathode. The electroplating apparatus 100A may further include a thief power supply 50. The thief power supply 50 may be similar to the power supply to bias the working electrode 5.

The electroplating system 100A may further include a control system (not depicted) for controlling the bias applied by the power supply 40 to the working electrode and the counter electrode 10, and the bias applied by the thief power supply 50 to the thief electrode 20*a* and the counter electrode 10.

The control system may employ a series of timers. A first timer controls duration of application of power to the working electrode 5 and, hence, controls metal deposited on the working electrode 5. A second timer controls a duration of application of power to the thief electrode 20*a*. In one example, the timers are employed to dictate the duration of the application of power being supplied from the power supply 40 and the thief power supply 50. The amount of power applied to the thief electrode 20*a* impacts the plating at the edge of the working electrode 5. By increasing the duration of the application of power to the thief electrode 20*a*, the amount of material that is being deposited on the edge of the work electrode 5 may be decreased, and by decreasing the duration of power to the thief electrode 20*a*, the amount of material that is being deposition that is being deposited on the edge, i.e., perimeter, may be increased. Such an embodiment has been utilized to electroplate copper in the range of from 100 nm to 2 microns with a variation in the thickness across the deposition substrate, i.e., working electrode 5, of less than 5% of one sigma (one standard deviation) for the thickness of the plating. In another embodiment, the variation in the thickness across the deposition substrate, i.e., working electrode 5, is less than 3% of one sigma (one standard deviation) for the thickness of the plating. In another embodiment, the material being deposited by electroplating may be deposited to a thickness ranging from 10 microns to 100 microns.

The out of plane non-blocking thief electrode 20*a* configuration that is depicted in FIGS. 2A-2C increases the degree of uniformity in the metal plating when compared to thief electrode configurations that have an exterior face that is coplanar with the plating surface of the working electrode. In comparison, to an out of plane non-blocking thief electrode 20*a*, a thief electrode having an exterior face that is planar with the plating surface produces a plating having a variation in the thickness across the deposition substrate, i.e., working electrode 5, that is greater than 10% of one sigma for the thickness of the plating.

Figure 3:
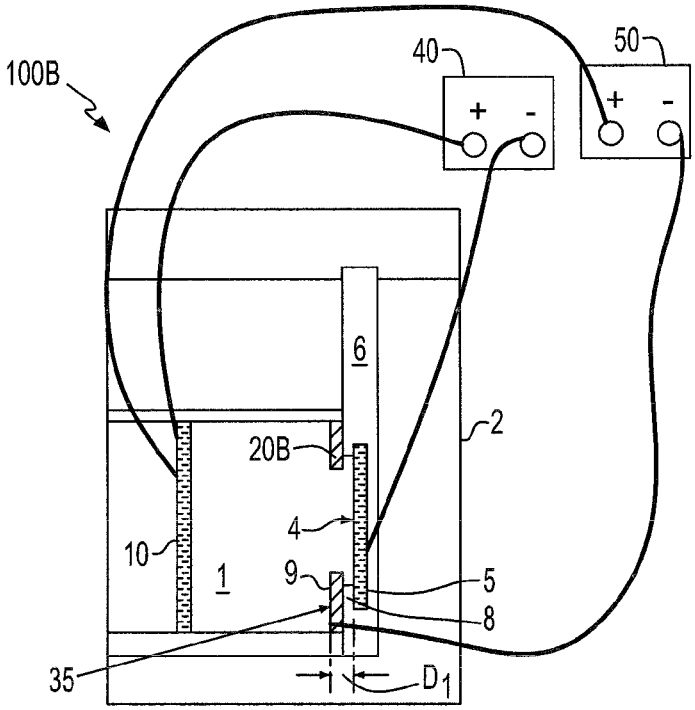
FIG. 3 is a side cross-sectional view of an electroplating apparatus including an out of plane blocking thief electrode, in accordance with one embodiment of the present disclosure.

FIG. 3 depicts one embodiment of an electroplating apparatus 100B including an out of plane blocking thief electrode 20*b*, in accordance with one embodiment of the present disclosure. As used herein, the term "blocking" as used to describe the thief electrode 20*b* means that a portion of the thief electrode 20*b* extends beyond the edge of the lip portion 8 of the holder 6 that is retaining the working electrode 5. The portion of the thief electrode 20*b* that extends past the edge of the lip portion 8 of the holder 6 overlaps the plating surface 4 of the working electrode 5, hence blocking a portion of the plating surface 4. The holder 6 is not being plated. Similar to the thief electrode 20*a* depicted in FIGS. 2A-2B, the thief electrode 20*b* depicted in FIG. 3 has an exterior surface 35 that is offset from the plating surface 4 of the working electrode 5. In one embodiment, the dimension D1 defining the degree by which the exterior face 35 of the thief electrode 20*b* is offset from the plating surface 4 of the working electrode 5 ranges from 0.5 mm to 50 mm. In another embodiment, the dimension D1 defining the degree by which the exterior face 35 of the thief electrode 20*b* is offset from the plating surface 4 of the working electrode 5 ranges from 1 mm to 5 mm.

In one embodiment, the thief electrode 20*b* has a body that includes a rim portion 9 overlapping the plating surface 4 of the working electrode 5 about a perimeter of the working electrode 5. In the embodiments of the present disclosure, in which the working electrode has a diameter ranging from 10 mm to 500 mm, the rim portion 9 extends beyond the edge of the lip portion 8 of the holder 6 for the working electrode 5 by a dimension ranging from 1 mm to 100 mm. In another embodiment, the rim portion 9 extends beyond the edge of the lip portion 8 of the holder 6 for the working electrode 5 by a dimension ranging from 1 mm to 10 mm.

Typically, the rim portion 9, i.e., blocking portion, of the thief electrode 20*b* is continuously present about an entirety of the perimeter of the working electrode 5. By "continuously present" it is meant that there are no breaks in the rim portion 9 of the body of the thief electrode 20*b* that is present about the entirety of the perimeter of the working electrode 5. Typically, the rim portion 9 overlaps 1% to 20% of the surface area of the working electrode 5. In one embodiment, the rim portion 9 overlaps 5% to 10% of the surface area of the working electrode 5. In one embodiment, the outline of the rim portion 9 of the thief electrode 20*b* defines a window that exposes a centralized portion of the plating surface 4 of the working electrode 5.

With the exception of the rim portion 9 of the thief electrode 20*b*, the above description for the thief electrode 20*a*, such as its' composition and connectivity to the thief power supply 50, in connection with the embodiments consistent with FIGS. 2A-2C are suitable for the thief electrode 20*b* depicted in FIG. 3. It is noted that the above disclosure describing the work electrode 5, counter electrode 10, plating tank 2, plating electrolyte 1, and power supply 40 that are described above with reference to embodiments consistent with FIGS. 2A-2C are equally applicable to the embodiment depicted in FIG. 3.

In addition to providing increased uniformity in the deposited plating, a thief electrode 20*b* that is out of partially blocking the working electrode 5 can substantially reduce the current applied to the thief electrode 20*b*, and thus reduce the electrochemical reaction rate occurring on the thief electrode 20*b*, or in turn enable a different electrochemical reaction.

FIGS. 4A-6 depict embodiments of the present disclosure that include polarized shields 20*c*, 20*d*. The polarized shield 20*c*, 20*d* functions similar to the thief electrodes 20*a*, 20*b*. The polarized shield 20*c*, 20*d* allows for easier cleaning, as the thief electrodes 20*a*, 20*b* may only be cleaned after the parts to be plated have been removed from the plating tank.

Figure 4A:
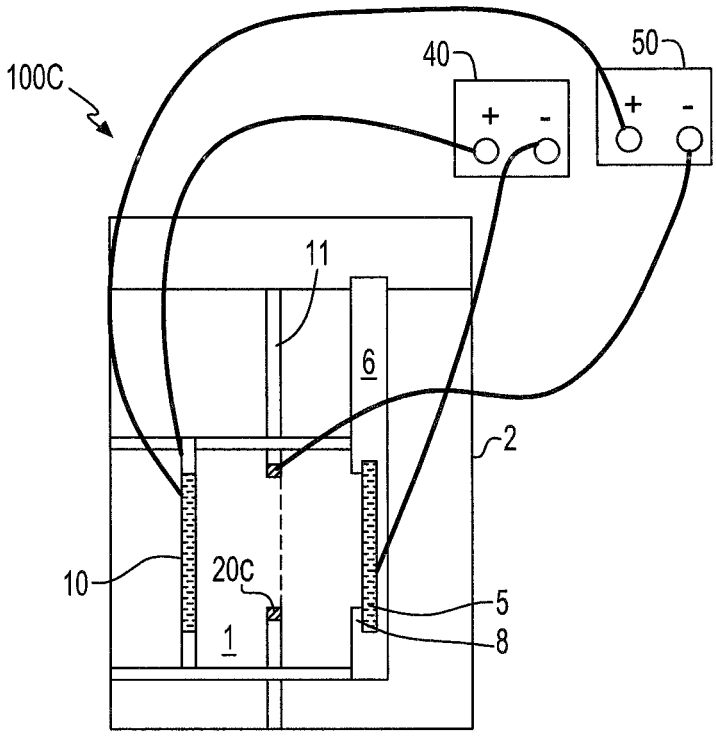
FIG. 4A is a side cross-sectional view of an electroplating apparatus including a tunable edge shield thief electrode, in accordance with one embodiment of the present disclosure.
Figure 4B:
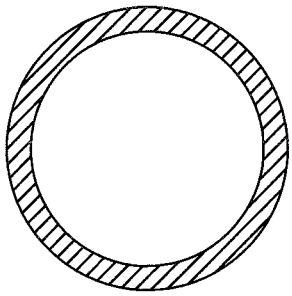
FIG. 4B is a perspective view of a thief electrode as used in the electroplating apparatus that is depicted in FIG. 4A, in which the thief electrode is substantially circular, in accordance with one embodiment of the present disclosure.
Figure 4C:
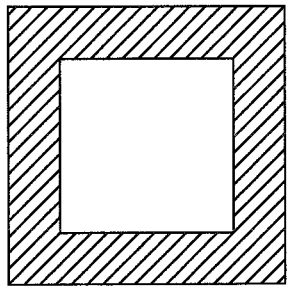
FIG. 4C is a perspective view of a thief electrode as used in the electroplating apparatus that is depicted in FIG. 4A, in which the thief electrode is multi-sided, in accordance with one embodiment of the present disclosure.

FIGS. 4A-4C depict one embodiment of an electroplating apparatus 100C including a tunable edge shield thief electrode 20*c*. The tunable edge shield thief electrode 20*c* may be a non-blocking or a blocking thief electrode. The tunable edge shield thief electrode 20*c* is mounted on a holder 11 that is separate from the holder 6 that retains the working electrode 5, in which the tunable edge shield thief electrode 20*c* is present between the working electrode 5 and the counter electrode 10. The tunable edge shield thief electrode 20*c* may be separated from the working electrode 5 by a dimension D2 ranging from 5 mm to 600 mm. In another example, the tunable edge shield thief electrode 20*c* may be separated from the working electrode 5 by a dimension D2 ranging from 100 mm to 300 min. In yet another example, the tunable edge shield thief electrode 20*c* may be separated from the working electrode 5 by a dimension D2 ranging from 200 mm to 300 mm. Although, the tunable edge shield thief electrode 20*c* is depicted as being positioned at the midpoint between the working electrode 5 and the counter electrode 10, embodiments have been contemplated in which the tunable edge shield thief electrode 20*c* is present in closer proximity to the working electrode 5 or in closer proximity to the counter electrode 10.

The tunable edge shield thief electrode 20*c* typically has an independent power supply, i.e., edge shield thief electrode power supply 55, that is similar to the power supply 50 for the thief electrodes 20*a*, 20*b* that is described above with reference to FIGS. 2A-3. In the embodiment that is depicted in FIG. 4A, the positive terminal of the tunable edge shield thief electrode 55 is electrically connected to the counter electrode 10 and the negative terminal of the tunable edge shield thief electrode 55 is electrically connected to the tunable edge shield thief electrode 20*c*.

FIG. 4B depicts one embodiment of a substantially circular tunable edge shield thief electrode 20*c*. FIG. 4C depicts one embodiment of a multi-sided tunable edge shield thief electrode 20*c*. Although, the tunable edge shield thief electrode is not mounted to the holder 6 for the working electrode 5, the tunable edge shield thief electrode 20*c* is present about an outline of the perimeter of the working electrode 5. The shape of the tunable edge shield thief electrode 20*c* images the outline of the working electrode 5.

With the exception of the tunable edge shield thief electrode 20*c* being mounted on a separate holder than the working electrode 5, the above description regarding the composition of the thief electrode 20*a*, and the degree in which the thief electrode blocks the plating surface 4 in embodiments having a blocking thief, is suitable for the tunable edge shield thief electrode 20*c* that is depicted in FIGS. 4A-4C. It is noted that the above disclosure describing the work electrode 5, counter electrode 10, plating tank 2, plating electrolyte 1, and power supply 40 that are described above with reference to embodiments consistent with FIGS. 2A-3 are equally applicable to the embodiments depicted in FIGS. 4A-4C.

Figure 5A:
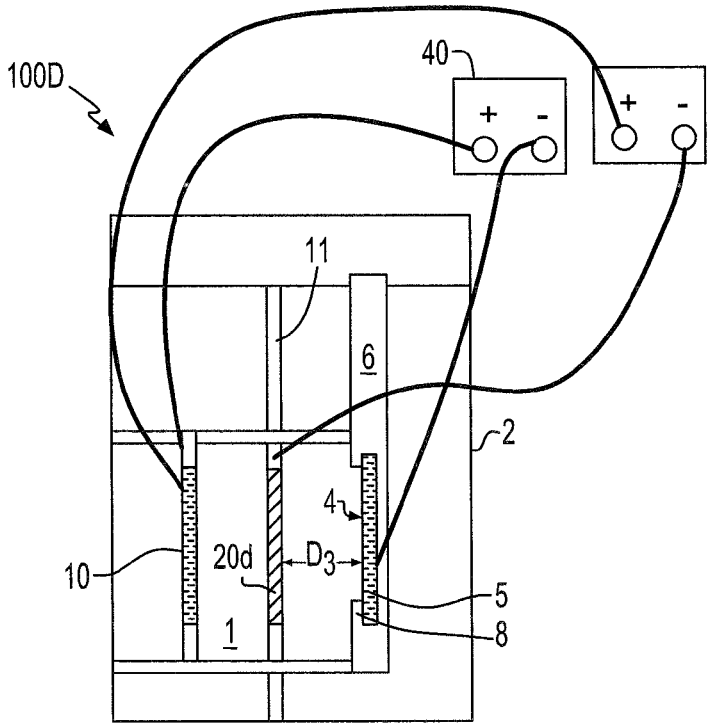
FIG. 5A is a side cross-sectional view of an electroplating apparatus including a full tunable shield thief electrode, in accordance with one embodiment of the present disclosure.
Figure 5B:
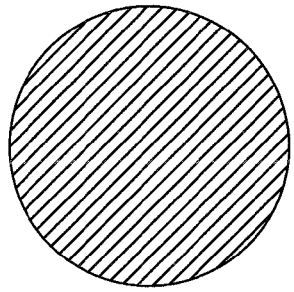
FIG. 5B is a perspective view of a full tunable shield thief electrode as used in the electroplating apparatus that is depicted in FIG. 5A, in which the full tunable shield thief electrode is substantially circular, in accordance with one embodiment of the present disclosure.
Figure 5C:
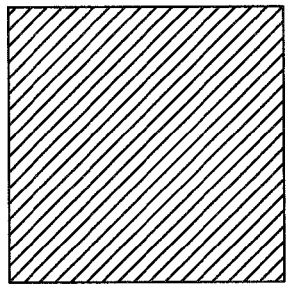
FIG. 5C is a perspective view of a full tunable shield thief electrode as used in the electroplating apparatus that is depicted in FIG. 5A, in which the full tunable shield thief electrode is multi-sided, in accordance with one embodiment of the present disclosure.

FIG. 5A-5C depict one embodiment of an electroplating apparatus 100*d* including a full tunable shield thief electrode 20*d*. A full tunable shield thief electrode 20*d* is a thief electrode that extends over the entirety of the working electrode 5. By extending over the entirety of the working electrode 5, the full tunable shield thief electrode 20*d* overlaps the entirety of the plating surface 4 of the working electrode. The full tunable shield thief is composed of a wire mesh material. The wire mesh material is typically composed of stainless steel or titanium (Ti) with platinized Ti or Pt being used when used to generate $H_2$, and in some examples has a wiring diameter ranging from 0.25 mm to 1.25 mm, and has a grid spacing that ranges from 1 mm to 10 mm. In one example, the wiring diameter of the wire mesh that provides the thief electrode 20*a* ranges from 0.5 mm to 0.75 mm, and has a grid spacing that ranges from 2 mm to 5 mm. The composition of the wire mesh material and its geometry is selected to allow for maximum flow while maintaining a smooth electric field.

The full tunable shield thief electrode 20*d* is mounted on a holder 11 that is separate from the holder 6 that retains the working electrode 5, in which the full tunable shield thief electrode 20*d* is present between the working electrode 5 and the counter electrode 10. The full tunable shield thief electrode 20*d* may be separated from the working electrode 5 by a dimension D3 ranging from 5 mm to 600 mm. In another example, the full tunable shield thief electrode 20*d* may be separated from the working electrode 5 by a dimension D3 ranging from 100 mm to 300 mm. In yet another example, the full tunable shield thief electrode 20*d* may be separated from the working electrode 5 by a dimension D3 ranging from 200 mm to 300 mm. Although, the full tunable shield thief electrode 20*d* is depicted as being positioned at the midpoint between the working electrode 5 and the counter electrode 10, embodiments have been contemplated in which the full tunable shield thief electrode 20*d* is present in closer proximity to the working electrode 5 or in closer proximity to the counter electrode 10. FIG. 5B depicts one embodiment of a substantially circular full tunable shield thief electrode 20*d*. FIG. 5C depicts one embodiment of a full tunable shield thief electrode 20*d*.

Figure 6:
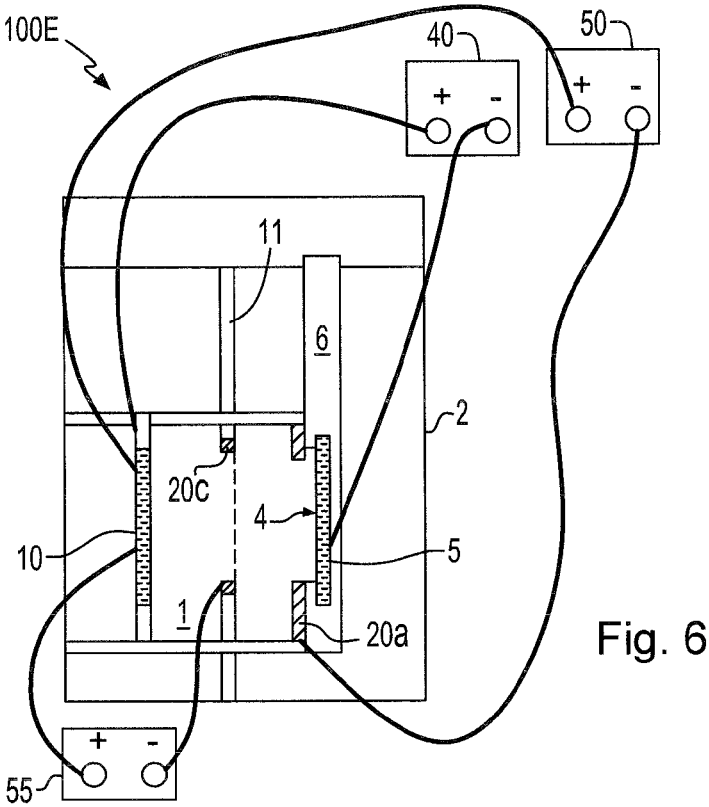
FIG. 6 is a side cross-sectional view of an electroplating apparatus including a tunable edge shield thief electrode used in combination with an out of plane non-blocking thief electrode, in accordance with one embodiment of the present disclosure.

FIG. 6 depict an electroplating apparatus 100*e* including a tunable edge shield thief electrode 20*c* used in combination with an out of plane non-blocking thief 20*a*. Although not depicted in FIG. 6, the electroplating apparatus may also include the combination of a tunable edge shield thief electrode used in combination with an out of plane blocking thief. The electroplating apparatus may also include the combination of a full tunable shield thief electrode used in combination with an out of plane blocking thief, or an out of plane non-blocking thief.

Figure 7A:
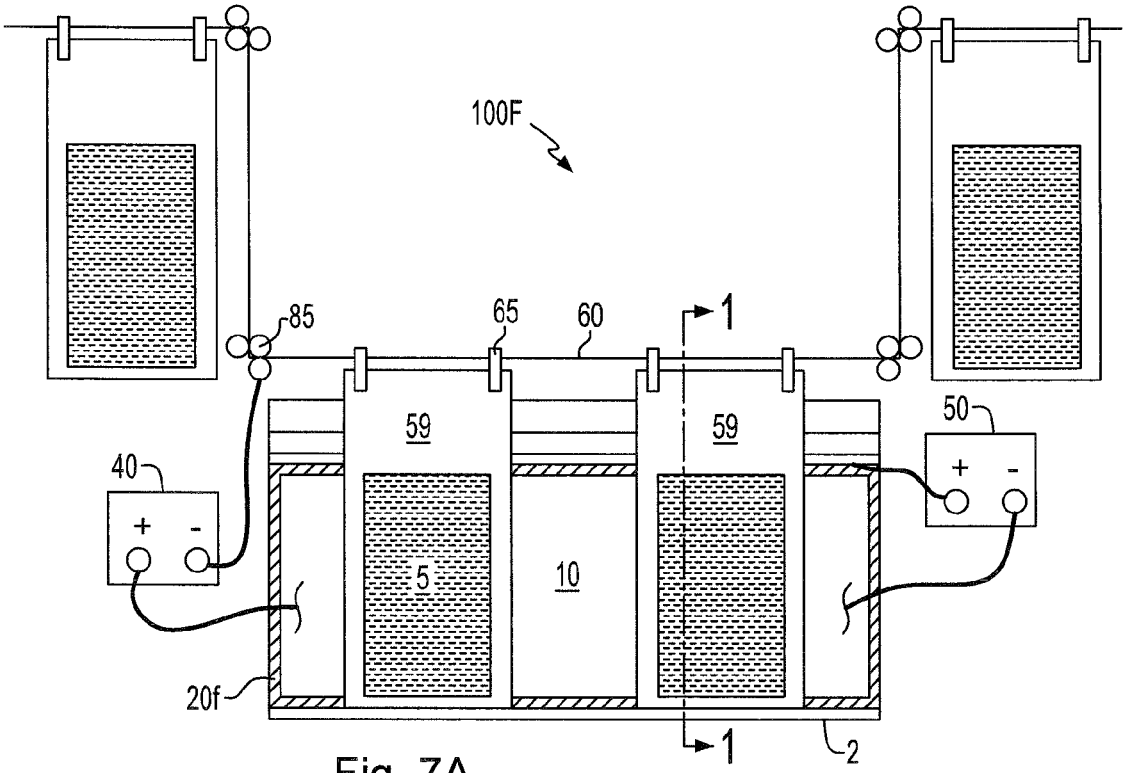
FIG. 7A is a side cross-sectional view of a continuous electroplating apparatus including an out of plane non-blocking thief electrode mounted to the shield of the anode, in accordance with one embodiment of the present disclosure.
Figure 7B:
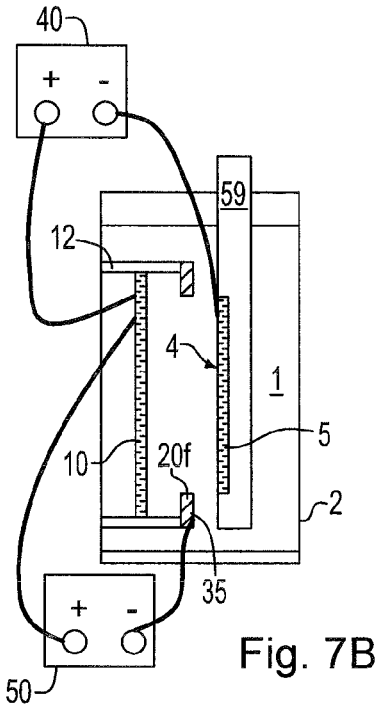
FIG. 7B is a cross-sectional view along section line 1-1 of the electroplating apparatus that is depicted in FIG. 7A, in which the electroplating apparatus is a single side electroplating apparatus.
Figure 7C:
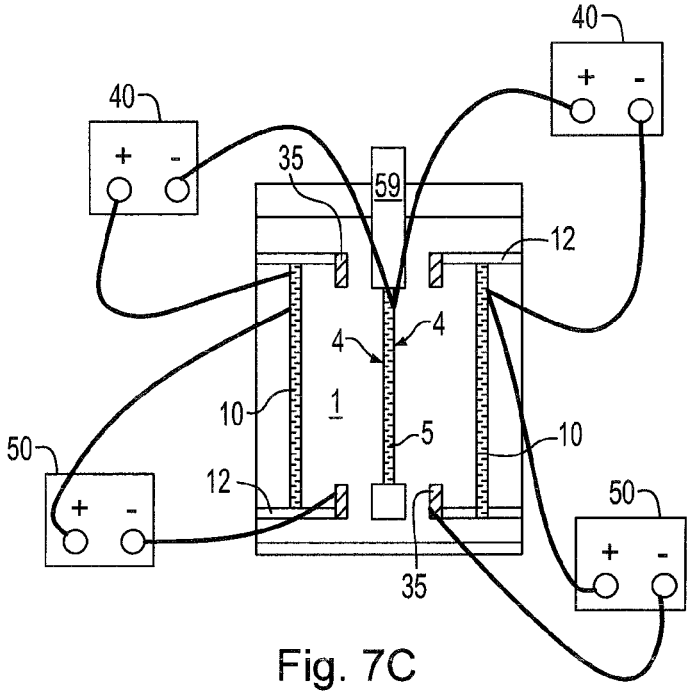
FIG. 7C is a cross-sectional view along section line 1-1 of the electroplating apparatus that is depicted in FIG. 7A, in which the electroplating apparatus is a dual side electroplating apparatus.

FIGS. 7A-7C depict one embodiment a continuous electroplating apparatus 100*f* including an out of plane thief electrode 20*f* mounted to the holder 12 of the counter electrode 10. In one example, the continuous electroplating apparatus 100*f* is a conveyor type electroplating system. The conveyor electroplating system includes a plating tank 2 containing a plating electrolyte 1. The description of the plating tank 2 and the plating electrolyte 1 for the embodiments of the disclosure depicted in FIGS. 2A-6 are suitable for the plating tank 2 and the plating electrolyte 1 employed in the continuous electroplating apparatus 100*f* depicted in FIGS. 7A-7C. The continuous electroplating system includes a pulley system 85 and a conductive tow line 60 for traversing the working electrode 5, i.e., plating surface 4, into and out of the plating tank 2 containing the plating electrolyte 1.

The counter electrode 10 and the out of plane thief electrode 20*f* are stationary with respect to the working electrode 5. In one embodiment, the counter electrode 10 and the out of plane thief electrode 20*f* are mounted to the plating tank 2. By mounting the out of plane thief electrode 20*f* on the plating tank 2, which is separate from the working electrode 5, the exterior face 35 of the out of plane thief electrode 20*f* is offset from the plating surface 4 of the working electrode 5. The out of plane thief electrode 20*f* may be a non-blocking or a blocking thief electrode.

The working electrode 5 is mounted on the conductive tow line 60. The working electrode 5 may be composed of any material that may be electroplated. Examples of suitable materials for the working electrode 5 include elemental elements including, but not limited to Cu, Ag, Ni, Fe, Al, Zn, Pd, platinized Ti, Co, Mo, Sn Ta, Ir, Pt, Pb, Bi, Cr, Nb, Zr, Au, SS 304, SS 316, Ti and combinations and alloys thereof. The working electrode 5 may also be composed of semiconductor materials, so long as the working electrode 5 is conductive so that it may be biased to attract positively charged metal ions from the plating electrolyte 1. The working electrode 5 may have any geometry to be plated.

The working electrode 5 is mounted to a holder 59 that is connected to the conductive tow line 60 and supports the working electrode 5 while traversed through the plating tank 2. The holder 59 may be composed of a non-conductive material, i.e., insulating material, such as a polymeric material, e.g., plastic or rubber, or glass material. Electrical communication between the conductive tow line 60 and the working electrode 5 is provided by contacts 65 that extend from, and are in direct contact with, each of the working electrode 5 and the conductive tow line 60. The contacts 65 may be composed of any conductive material, such as a metal.

The continuous electroplating apparatus 100*f* may further include a power supply 40 to bias the working electrode 5 and the counter electrode 10. The power supply 40 to bias the working electrode 5 and the counter electrode 10 may be a DC, AC, pulse and pulse reverse power supply. During the plating operation, DC power is typically employed. In other embodiments, pulsed plating may be utilized. In some instances, such as the beginning of a plating process, pulse reverse power may be utilized. AC current in connection with a frequency analyzer can provide diagnostic information about the quality of the plated material as a feedback loop that can then be used to turn the thief electrodes on and off. The power supply may also be bipolar, which may facilitate metal stripping operations. In the embodiment that is depicted in FIG. 7A, the positive terminal of the power supply 40 is electrically connected to the counter electrode 10 that is mounted to the plating tank 2, and the negative terminal of the power supply 40 is in electrical communication with the working electrode 5. More specifically, the negative terminal is connected to the conductive tow line 85, wherein electrical communication between the conductive tow line 85 and the working electrode 5 is provided by the contacts 65. In this example, the counter electrode 10 provides an anode, and the working electrode 5 provides a cathode. The continuous electroplating apparatus 100*f* may further include thief power supply 50. The thief power supply 50 is similar to the power supply 40 to bias the working electrode 5 and the counter electrode 10. In the embodiment that is depicted in FIG. 7A, the positive terminal of the thief power supply 50 is electrically connected to the counter electrode 10 and the negative terminal of the thief power supply 50 is electrically connected to the thief electrode 20*f* that is mounted on the plating tank 2.

FIG. 7B is a cross-sectional view along section line 1-1 of the electroplating apparatus 100*f* that is depicted in FIG. 7A, in which the electroplating apparatus 100*f* is a single side plating apparatus. FIG. 7C is a cross-sectional view along section line 1-1 of the electroplating apparatus 100*f* that is depicted in FIG. 7A, in which the electroplating apparatus 100*f* is a dual side plating apparatus. The shape of the thief electrode 20*f* images the outline of the working electrode 5.

Figure 8A:
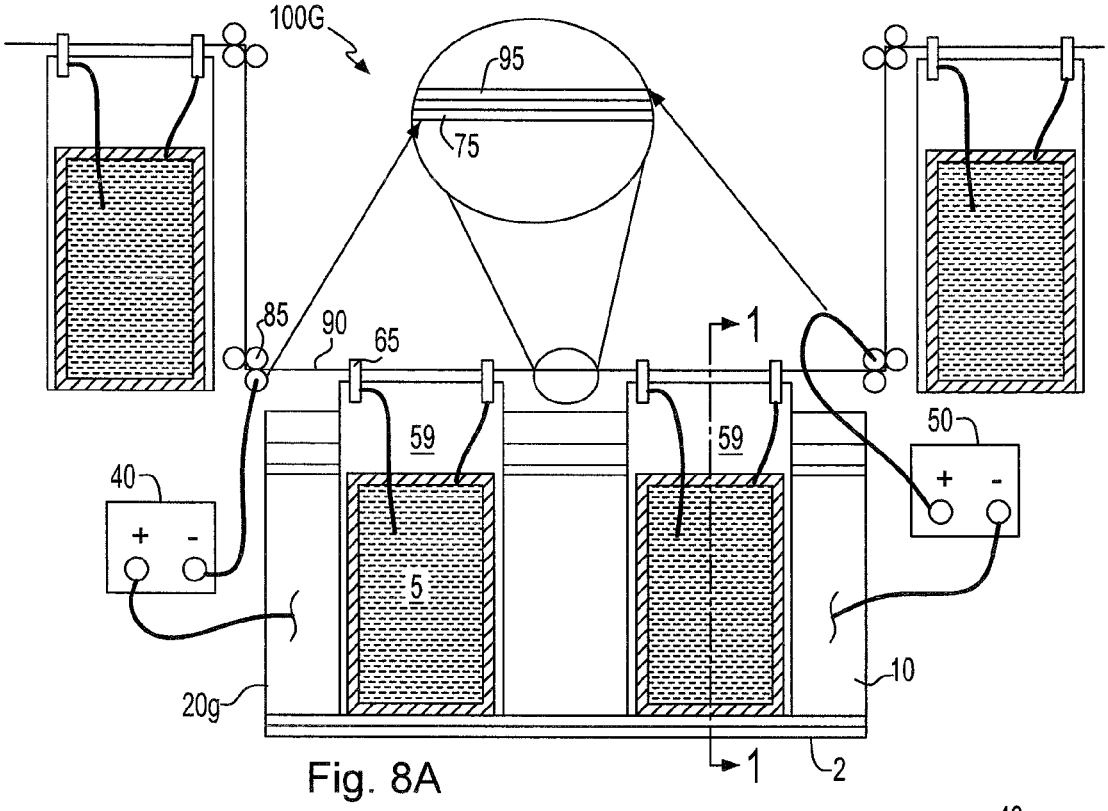
FIG. 8A is a side cross-sectional view of a continuous electroplating apparatus including an out of plane non-blocking thief electrode mounted to the holder of the cathode, in which electrical contact is provided by a conductive tow line, in accordance with one embodiment of the present disclosure.

FIG. 8A is a side cross-sectional view of a continuous electroplating apparatus 100*g* including an out of plane thief electrode 20*g* mounted to the holder 59 of the working electrode 5, in which electrical contact to the working electrode 5 and the thief electrode 20*g* is provided by a conductive tow line 90 composed of at least two wires.

In one example, the continuous electroplating apparatus 100*g* is a roll to roll electroplating system. The roll to roll electroplating system includes a plating tank 2 containing a plating electrolyte 1 and a pulley system 85, which are similar to the plating tank 2 and pulley system 85 that are described above in reference to FIGS. 7A-7C. The continuous electroplating apparatus 100*g* further includes a conductive tow line 90 for traversing the working electrode 5, i.e., plating surface 4, into and out of the plating tank 2 containing the plating electrolyte 1. The counter electrode 10 is mounted to the plating tank 2 and is stationary with respect to the working electrode 5.

The working electrode 5 and the out of plane thief electrode 20*g* are mounted to a holder 59 that is connected to a conductive tow line 70 that includes at least two separate wires, in which the wires are used to carry independent current to each of the working electrode 5 and the out of plane thief electrode 20*g*. The holder 59 supports the working electrode 5 while it traversed into and out of the plating tank 2 during the electroplating process. The holder 59 may be composed of a non-conductive material, i.e., insulating material, such as a polymeric material, e.g., plastic or rubber, or glass material.

The working electrode 5 may be composed of any material that may be electroplated. Examples of suitable materials for the working electrode 5 include elemental elements including, but not limited to Cu, Ag, Ni, Fe, Al, Zn, Pd, platinized Ti, Co, Mo, Sn Ta, Ir, Pt, Pb, Bi, Cr, Nb, Zr, Au, SS 304, SS 316, Ti and combinations and alloys thereof. The working electrode 5 may also be composed of semiconductor materials, so long as the working electrode 5 is conductive so that it may be biased to attract positively charged metal ions from the plating electrolyte 1. The working electrode 5 may have any geometry to be plated.

The out of plane thief electrode 20*g* may be a non-blocking or a blocking thief electrode. The out of plane thief electrode 20*g* is typically present about the perimeter of the working electrode 5, but is separated from the working electrode 5 to avoid shorting the device. An insulating spacer (not shown) may be present between the out of plane thief electrode 20*f* and the working electrode 5. The insulating spacer may be a component of the holder 59.

The shape of the out of plane thief electrode 20*g* images the outline of the working electrode 5. For example, when the working electrode 5 has a substantially circular perimeter, the out of plane thief electrode 20*g* is also substantially circular. When the working electrode has a multi-sided perimeter, the out of plane thief electrode 20*g* is also multi-sided. In one embodiment, the out of plane thief electrode 20*g* is continuously present about the perimeter of the working electrode 5. By "continuously present" it is meant that there are no breaks in the body of the out of plane thief electrode 20*g* that is present about the entirety of the perimeter of the working electrode 5. By out of plane it is meant that the exterior face 35 of the thief electrode 20*g* is not on the same plane as the plating surface 4 of the working electrode 5. Therefore, the exterior face 35 of the out of plane thief electrode 20*g* and the plating surface 4 of the working electrode 5 are not coplanar.

The continuous electroplating apparatus 100*g* may further include a power supply 40 to bias the working electrode 5 and the counter electrode 10. In the embodiment that is depicted in FIG. 8A, the positive terminal of the power supply 40 is electrically connected to the counter electrode 10 that is mounted to the plating tank 3, and the negative terminal of the power supply 40 is in electrical communication with the working electrode 5. More specifically, the negative terminal is connected to a first wire 75 of the conductive tow line 60, wherein electrical communication between the first wire 75 of the conductive tow line and the working electrode 5 is provided by the contacts 65. In this example, the counter electrode 10 provides an anode, and the working electrode 5 provides a cathode. The continuous electroplating apparatus 100*g* may further include thief power supply 50. In the embodiment that is depicted in FIG. 8A, the positive terminal of the thief power supply 50 is electrically connected to the counter electrode 10 and the negative terminal of the thief power supply 50 is electrically connected to the out of plane thief electrode 20*g* that is mounted on the holder 59 of the working electrode 5. More specifically, the negative terminal is connected to a second wire 95 of the conductive tow line 90, wherein electrical communication between the second wire 95 of the conductive tow line and the out of plane thief electrode 20*g* is provided by the contact 65.

Figure 8B:
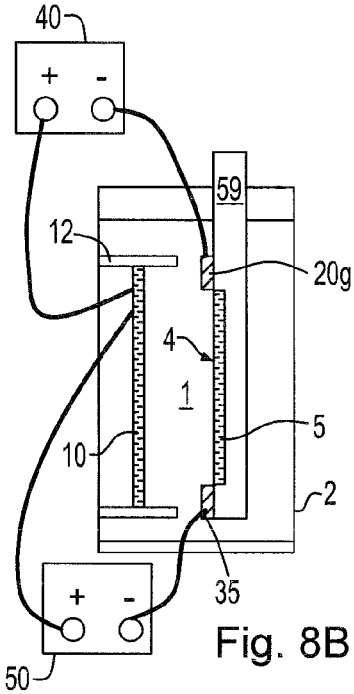
FIG. 8B is a cross-sectional view along section line 1-1 of the electroplating apparatus that is depicted in FIG. 8A, in which the electroplating apparatus is a single side plating apparatus.
Figure 8C:
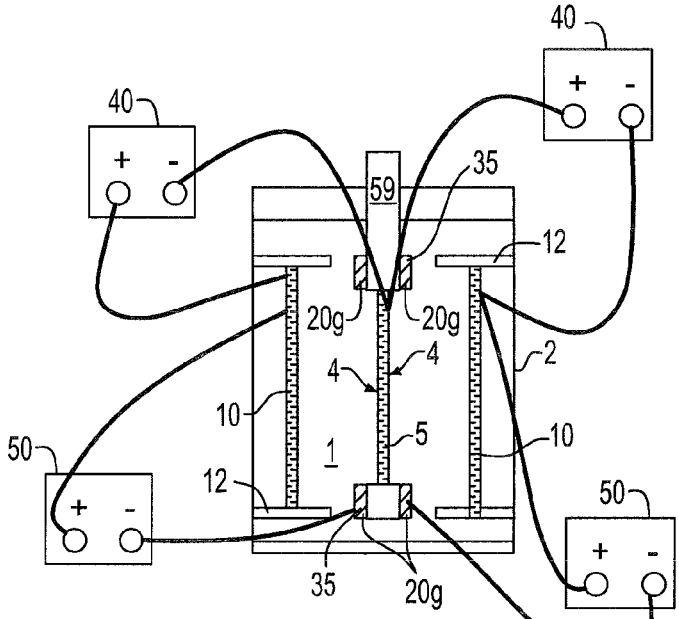
FIG. 8C is a cross-sectional view along section line 1-1 of the electroplating apparatus that is depicted in FIG. 8A, in which the electroplating apparatus is a dual side plating apparatus.

FIG. 8B is a cross-sectional view along section line 1-1 of the electroplating apparatus that is depicted in FIG. 8A, in which the electroplating apparatus is a single side plating apparatus. FIG. 8C is a cross-sectional view along section line 1-1 of the electroplating apparatus that is depicted in FIG. 8A, in which the electroplating apparatus is a dual side plating apparatus.

Figure 9:
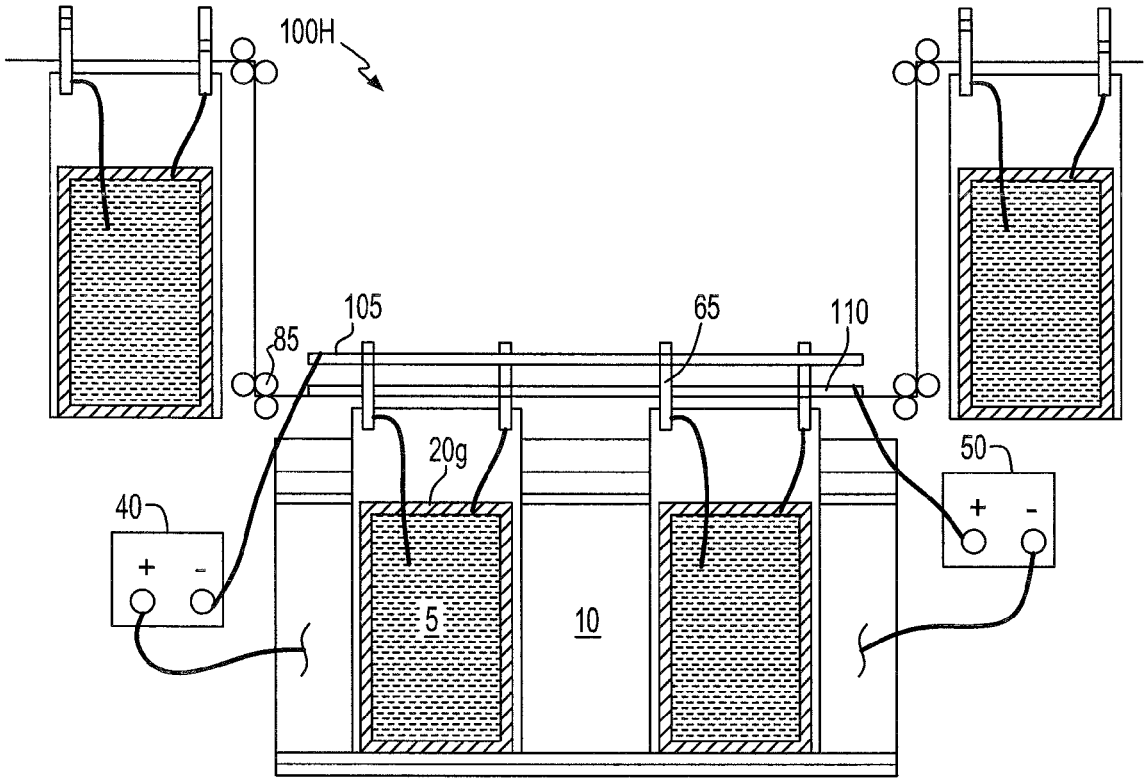
FIG. 9 is a side cross-sectional view of a continuous electroplating apparatus including an out of plane non-blocking thief electrode mounted to the holder of the cathode, in which electrical contact is provided by a conductive tow bar and both the holder and the out of place non-blocking thief electrode are shorted together, in accordance with one embodiment of the present disclosure.

FIG. 9 is a side cross-sectional view of a continuous electroplating apparatus 100*h* that is similar to the continuous electroplating apparatus 100*g* that is depicted in FIGS. 8A-8C, with the exception that the two wire conductive tow 60 is replaced conductive tow bars 105, 110. In this embodiment, the negative terminal of the power supply 40 is in electrical communication with the working electrode 5 through a first conductive tow bar 105. More specifically, the negative terminal is connected to first conductive tow bar 105, wherein electrical communication between the first conductive tow bar 105 and the working electrode 5 is provided by the contacts 65. In this embodiment, the negative terminal of the thief power supply 50 is electrically connected to the out of plane thief electrode 20*g* through a second conductive tow bar 110. More specifically, the negative terminal is connected to the second conductive tow bar 110, wherein electrical communication between the second conductive tow bar 110 and the out of plane thief electrode 20*g* is provided by the contact 65. The tow that supports the working electrode 5 as it is traversed into and out of the plating tank 2 during the electroplating process typically does not carry current to the working electrode 5 or the out of plane thief electrode 20*g*.

Figure 10A:
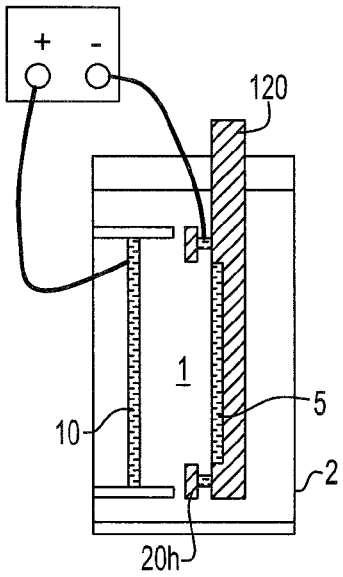
FIGS. 10A and 10B are front cross-sectional views depicting embodiments of a continuous electroplating apparatus in which the entire holder of the cathode is composed of a mesh and provides a thief electrode, in accordance with one embodiment of the present disclosure.
Figure 10B:
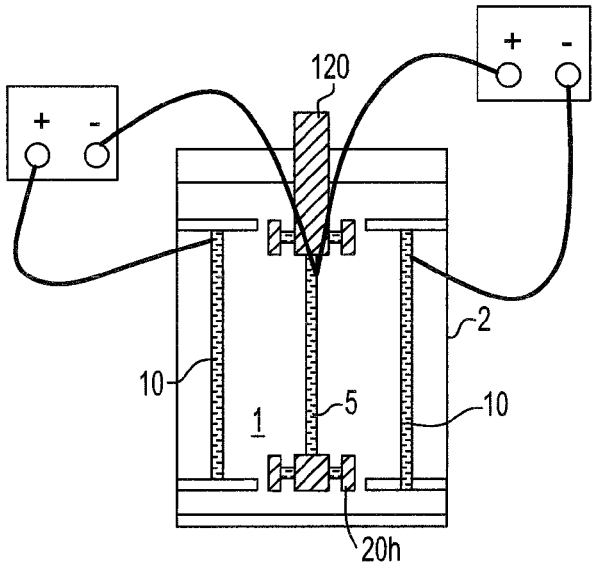

FIGS. 10A and 10B depict embodiments of a continuous electroplating apparatus in which the entire holder 120 of the working electrode 5, i.e., cathode, is composed of a mesh and provides a thief electrode 20*h*. In this case, the thief electrode 20*h* and the working electrode 5 may have the same potential. However, due to the physical location of the thief electrode 20*h* relative to the working electrode 5, and the counter electrode 10, the thief electrode 20*h* can still selectively thief current from the other high field line areas of the working electrode 5. By making the entire holder 6 conductive, it enables the field lines to be flattened on the thief and make completely flat the field lines on the part. By making the entire holder 6 conductive it also simplifies the holder designs and allows a simple way to clean them prior to reintroduction into the plating tool. In some embodiments, the mesh construction of the thief electrode 20*h* allows for easier removed of plated material and better control of current distribution during electrochemical processes.

In another aspect, an electroplating method is provided that includes providing a plating tank containing a plating electrolyte, positioning an anode in contact with the plating electrolyte, and positioning a cathode system in contact with the plating electrolyte.

The cathode system includes a working electrode having a plating surface and a thief electrode that is separated from the working electrode. The thief electrode includes a face that is in contact with the plating electrolyte and is offset from the plating surface of the working electrode. A bias is applied to the anode and the cathode system, wherein metal compound dissociates to provide the metal ions that are plated on the surface of the working electrode. The plating formed on the plating surface of the working electrode has a uniform thickness from the perimeter, i.e., edge, of the plating surface to the center of the plating surface.

The current applied to the thief of the cathode system ranges from 0.1 mA/cm$^2$ to 10 mA/cm$^2$, and the current applied to the working electrode ranges from 1 mA/cm$^2$ to 200 mA/cm$^2$.

It has been determined that in some embodiments, positioning the thief electrode to be offset from the plating surface of the working electrode increases the uniformity of the plating thickness. Electroplating devices that do not include a thief electrode, or include a thief electrode that is not offset from the plating surface of the working electrode, have increased plating thickness at the edge, i.e., perimeter, of the working electrode. In comparison, the metal plate produced by an electroplating apparatus in which the face of the thief electrode that is in contact with the plating electrolyte is offset from the plating surface of the working electrode has a uniform thickness extending across the entirety of the plating surface including the portion of the plating at the edge of the working electrode. The uniform thickness may be a variation in the thickness across the deposition substrate, i.e., working electrode, of less than 5% of one sigma (one standard deviation) for the thickness of the plating. In another embodiment, the variation in thickness across the deposition substrate may be less than 3% of one sigma for the thickness of the plating.

The thief electrodes and polarized shields that are disclosed herein may either operate in plating metal or in generating gases. The decision regarding the function of the thief electrodes and the polarized shields may be dependent upon if the gases will stay dissolved in liquid or form bubbles. In the later case, in some embodiments, it may be advantageous that the thief electrode is not mounted to the holder for the working electrode. Further, in some embodiments, a mesh thief electrode composed of platinized Pt or platinized Ti is used to generate $H_2$ gas.

In addition to the above-described electroplating process, the apparatuses described above may be employed in electroless processes. For example, electroless processes can benefit from application of the above-described apparatuses during the initial stages of plating by applying an electric field at the very beginning of the process. Nickel phosphorus (NiP) is one example of an electroless plating process that may benefit from the application of an electrical field at the very beginning of the process. Nickel phosphorus plating is notorious for exhibiting a skip plating phenomena. Initiating plating uniformity across the deposition surface is one mechanism by which skip plating can be minimized. By setting up a current between the anode and the thief, in which no power is applied to the working electrode, the uniformity of the initial plating of nickel phosphorus may be enhanced. In another example, the uniformity of the initial plating of the nickel phosphorus may be enhanced by setting up a current between the anode, the thief and the working electrode.

The apparatuses and methods disclosed herein are suitable for depositing thin platings, such as deposited layers having a thickness ranging from 100 nm to 2 microns, or thicker platings, such as deposited layers having a thickness ranging from 10 microns to 100 microns. In one embodiment, the apparatuses and methods may provide a variation in the thickness across the deposition substrate, i.e., working electrode 5, of less than 5% of one sigma (one standard deviation) for the thickness of the plating. In another embodiment, the variation in the thickness across the deposition substrate, i.e., working electrode 5, is less than 3% of one sigma (one standard deviation) for the thickness of the plating.

The deposition surface may have an area of up to 700 cm$^2$. In some instances, the deposition surface may have an area that can be as greater as 1 meter$^2$, such as 7,200 cm$^2$. The surfaces on which the plating may be deposited may have a varied topography. In the instances in which the deposition surface has a varied topography, the apparatuses and methods disclosed herein provide deposited layers on the varied topography having a uniform thickness.

It is noted that the above described thief electrodes are equally applicable to the anode and cathode electrodes.

While the invention has been particularly shown and described with respect to preferred embodiments thereof, it will be understood by those skilled in the art that the foregoing and other changes in form and details may be made therein without departing from the spirit and scope of the present invention.

What is claimed is:

1. An electrode system of an electroplating apparatus, the electrode system comprising:

a working electrode comprising a supported portion and an exposed portion, wherein the exposed portion defines a plating surface;

a thief electrode that is separated from the working electrode, wherein an exterior face of the thief electrode is offset from the plating surface of the working electrode; and a holder configured to support the working electrode, the holder comprising a lip portion comprising:

a first surface extending over and directly contacting the supported portion of the working electrode, and a second surface opposing the first surface and directly contacting the thief electrode, wherein the thief electrode comprises a rim portion extending beyond an edge of the lip portion of the holder and overlapping the plating surface of the working electrode about a perimeter of the working electrode, and wherein the working electrode and the thief electrode are configured to be in electrical communication with at least one power supply.

2. The electrode system of claim 1, wherein the thief electrode comprises a window that exposes a centralized portion of the plating surface of the working electrode.

3. The electrode system of claim 1, wherein the working electrode has a circular geometry and the thief electrode has a circular geometry.

4. The electrode system of claim 1, wherein the working electrode is multi-sided and the thief electrode is multi-sided.

5. The electrode system of claim 1, wherein the thief electrode is a mesh electrode.

6. The electrode system of claim 1, wherein the thief electrode is a solid electrode.

7. The electrode system of claim 1, wherein the working electrode is composed of Cu, Cu, Ag, Ni, Fe, Al, Zn, Pd, platinized Ti, Co, Mo, Sn Ta, Ir, Pt, Pb, Bi, Cr, Nb, Zr, Au, SS 304, SS 316, Ti or combinations or alloys thereof.

8. The electrode system of claim 1, wherein the thief electrode is composed of Cu, Ag, Ni, Fe, Al, Zn, Pd, platinized Ti, Co, Mo, Sn Ta, Ir, Pt, Pb, Bi, Cr, Nb, Zr, Au, SS 304, SS 316, Ti or combinations or alloys thereof.

9. The electrode system of claim 1, wherein the electrode system is employed in a continuous roll to roll plating system, wherein the thief electrode is mounted to the holder and is continuously traversed through a plating tank, wherein a counter electrode is stationary and is mounted to the plating tank.

* * * * *